US012203246B2

(12) United States Patent
Kunz et al.

(10) Patent No.: US 12,203,246 B2
(45) Date of Patent: Jan. 21, 2025

(54) BLANK FOR FABRICATING WEAR MEMBER FOR A GROUND-ENGAGING TOOL

(71) Applicant: Caterpillar Inc., Peoria, IL (US)

(72) Inventors: Phillip J. Kunz, Morton, IL (US); Adam Michael Dean, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 13 days.

(21) Appl. No.: 18/207,742

(22) Filed: Jun. 9, 2023

(65) Prior Publication Data

US 2023/0323642 A1 Oct. 12, 2023

Related U.S. Application Data

(63) Continuation of application No. 16/667,979, filed on Oct. 30, 2019, now Pat. No. 11,718,979.

(51) Int. Cl.
*E02F 9/28* (2006.01)

(52) U.S. Cl.
CPC ..... *E02F 9/2883* (2013.01)

(58) Field of Classification Search
CPC ..... E02F 9/2816; E02F 9/2858; E02F 9/2883
See application file for complete search history.

(56) References Cited

U.S. PATENT DOCUMENTS

| | | | | |
|---|---|---|---|---|
| 2,032,875 | A | 3/1936 | Dwight | |
| 2,666,272 | A | 1/1954 | Everett | |
| 3,685,177 | A | 8/1972 | Hahn | |
| 3,947,982 | A | 4/1976 | Mantovani | |
| 4,208,815 | A | 6/1980 | Yunker | |
| 4,343,516 | A | 8/1982 | Aden | |
| 5,241,765 | A | 9/1993 | Jones | |
| 6,188,680 | B1 | 2/2001 | Ohki | |
| 9,371,631 | B2 | 6/2016 | Karlsson | |
| 9,518,379 | B2 | 12/2016 | Kunz | |
| 9,758,947 | B2 | 9/2017 | Serrurier | |
| 9,995,021 | B2 | 6/2018 | Serrurier | |
| 9,995,022 | B2 | 6/2018 | Hooijmans | |
| 11,718,979 | B2 * | 8/2023 | Kunz | E02F 9/2858 37/455 |
| 2004/0037637 | A1 | 2/2004 | Lian | |
| 2015/0247306 | A1 | 9/2015 | Kunz | |
| 2016/0305095 | A1 | 10/2016 | Kunz | |
| 2017/0284073 | A1 | 10/2017 | Kunz | |

FOREIGN PATENT DOCUMENTS

| | | |
|---|---|---|
| DE | 7443383 | 5/1975 |
| JP | 2001342649 | 12/2001 |

* cited by examiner

*Primary Examiner* — Gary S Hartmann

(57) ABSTRACT

A blank for fabricating a wear member for a ground-engaging tool includes a one-piece block having a boss channel and a lock bore each formed therein. The one-piece block includes a peripheral edge that projects upon lateral sides and a front end of the one-piece block, the peripheral edge originating and terminating at a back end of the block, to form a continuous welding interface that is partially perimetric of the one-piece block, for welding to a body of a wear member. The blank can be used to fabricate a variety of different wear members including shrouds, tooth tips, edge protectors, or others.

13 Claims, 7 Drawing Sheets

BLANK FOR FABRICATING WEAR MEMBER FOR A GROUND-ENGAGING TOOL

CROSS-REFERENCE TO RELATED APPLICATIONS

The present disclosure is a continuation of U.S. patent application Ser. No. 16/667,979, filed Oct. 30, 2019, the entire disclosure of which is incorporated herein by reference.

TECHNICAL FIELD

The present disclosure relates generally to a fabricated wear member for a ground-engaging tool, and more particularly to a blank for fabricating a wear member having structure for accommodating a lock and a peripheral edge forming a welding interface for welding to a body of a wear member.

BACKGROUND

Ground-engaging tools including buckets, blades, shovels, and still others are used in a wide variety of machinery types throughout the world. Such ground-engaging tools are typically used to dig, push, load, or otherwise manipulate material ranging from soil to rock, landfill trash, or other debris. Depending upon the materials being worked, material contact surfaces of such ground-engaging tools can be subjected to relatively harsh wear conditions. Over time, wear of the material contact surfaces can limit the service life of such tools or degrade performance. To avoid the necessity of replacing the entire tool, many are equipped with replaceable wear members which can be bolted, welded, or otherwise fitted upon the tool and replaced when they wear out.

Replacement of wear members can be relatively labor intensive, and a variety of strategies are known for relatively efficiently swapping out used wear members for replacements. In some instances, a locking device can be used to securely fit a wear member upon a ground-engaging tool, then unlocked for replacement or service, without the need for welding to attach the wear member, or cutting, hammering, or other unduly burdensome servicing activities for removal. One example replaceable wear member for a ground-engaging tool is set forth in U.S. Pat. No. 9,995,022 to Hooijmans. Hooijmans proposes a dragline lip assembly having an upright member with a boss, and a wing shroud structured for securing by way of a lock assembly on the dragline lip.

SUMMARY OF THE INVENTION

In one aspect, a blank for fabricating a wear member for a ground-engaging tool includes a one-piece block with a front end, a back end, an upper surface, a bottom surface, a first lateral side, and a second lateral side. A boss channel is formed in the one-piece block and is open at the bottom surface and at the back end. A lock bore is formed in the one-piece block and extends downwardly from the upper surface to the boss channel. The one-piece block further includes a peripheral edge that projects upon each of the first lateral side, the second lateral side and the front end, and is located vertically between the lower surface and the bottom surface. The peripheral edge originates and terminates at the back end, such that the peripheral edge forms a continuous welding interface that is partially perimetric of the one-piece block, for welding the one-piece block to a body of a wear member for a ground-engaging tool.

In another aspect, a blank assembly for fabricating a wear member for a ground-engaging tool includes a one-piece block with a front end, a back end, an upper surface, a bottom surface, a first lateral side, and a second lateral side. A boss channel is formed in the one-piece block and is open at the bottom surface and at the back end, and a lock bore is formed in the one-piece block and extends downwardly from the upper surface to the boss channel. A lock is positioned within the lock bore and adjustable between an engagement state and a disengagement state to lock or unlock the one-piece block from a boss attached to a ground-engaging tool. The one-piece block further includes a peripheral edge that projects upon each of the first lateral side, the second lateral side, and the front end, and is located vertically between the upper surface and the bottom surface, and the peripheral edge forms a continuous welding interface that is partially perimetric of the one-piece block, for welding the one-piece block to a body of a wear member.

In still another aspect, a fabricated wear member for a ground-engaging tool includes a wear member body having a cutout formed therein, and a blank assembly positioned within the cutout. The blank assembly includes a one-piece block, and a lock positioned within the one-piece block. The one-piece block includes a front end, a back end, an upper surface, a bottom surface, a first lateral side, and a second lateral side, and has formed therein a boss channel that is open at the bottom surface and at the back end. The one-piece block further has a peripheral edge projecting upon each of the first lateral side, the second lateral side, and the front end, and having a shape that is complementary to a shape of the cutout. A weld attaches the wear member body to the peripheral edge.

DETAILED DESCRIPTION

Figure 1:
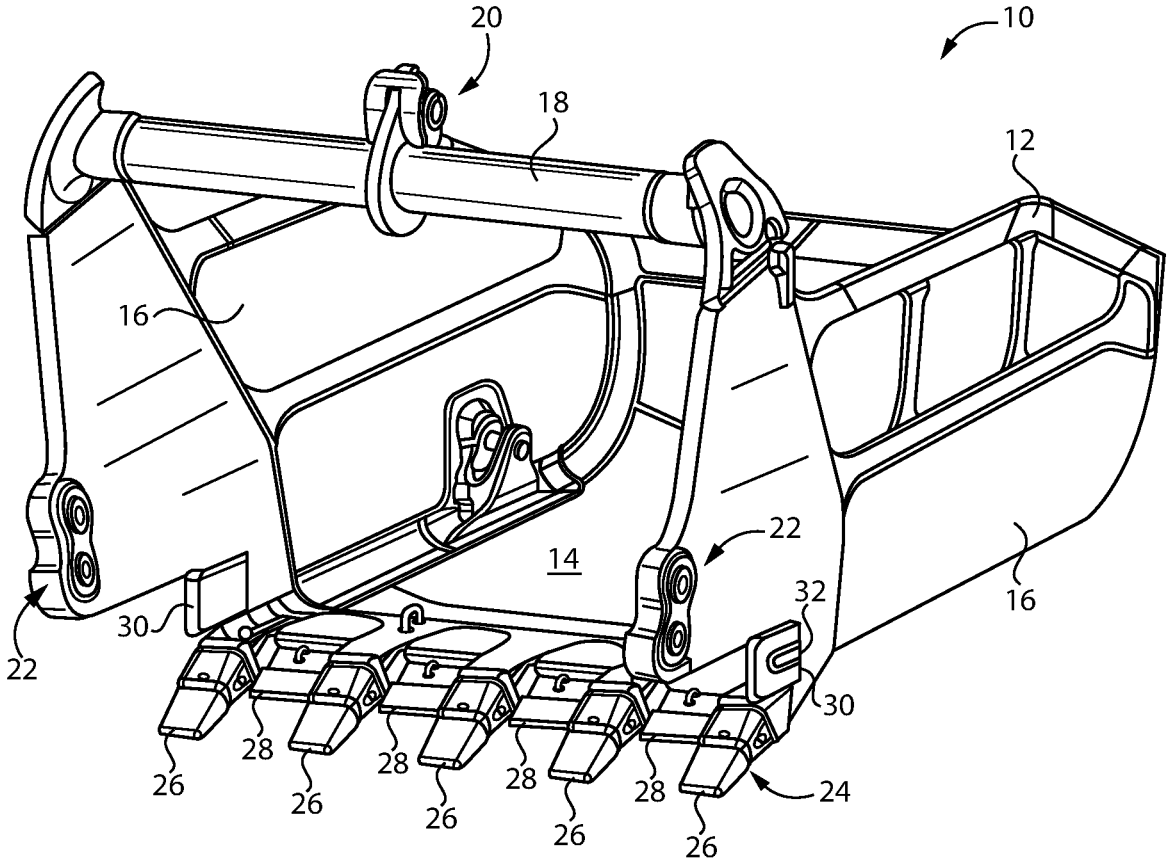
FIG. 1 is a diagrammatic view of a ground-engaging tool, according to one embodiment.

Referring to FIG. 1, there is shown a ground-engaging tool 10 according to one embodiment, and including a tool body 12 having a floor 14, lateral sides 16 extending generally upwardly from floor 14, and a bar 18 extending across and between lateral sides 16. Bar 18 may be equipped with a connecting element 20, and additional connecting elements 22 may be positioned upon sides 16. Ground-engaging tool 10 is shown in the context of a bucket such as might be used with a rope shovel or a dragline or similar machine. In other embodiments, a ground-engaging tool within the context of the present disclosure could include a backhoe bucket, an excavator bucket, a blade for a tractor or other off-highway vehicle, a ripper, or any of a great many other ground-engaging tools. Accordingly, connecting elements 20 and 22 could be structured to connect with a cable, a stick, a boom, lift arms, or a variety of other equipment suitable for lifting, lowering, tilting, or forward and backward movement of ground-engaging tool 10 in a suitable manner. Ground-engaging tool 10 further includes a forward cutting edge 24 that serves as a principle material engagement edge for cutting, digging, scraping, lifting, or otherwise interacting with material such as rock, gravel, sand, soil, landfill trash, concrete, coal, or a variety of other material types. Ground-engaging tool 10 is equipped with a plurality of teeth 26 mounted upon cutting edge 24, edge shrouds 28 interspersed with teeth 26, and wing shrouds 30. The following description includes subject matter of example wing shrouds and edge shrouds, however, it should be appreciated that the description is applicable by way of analogy to any wear member for any application contemplated within the context of the present disclosure.

In the illustrated embodiment, wing shrouds 30 are fabricated wear members formed from a blank assembly 32 that is lockingly mounted to a mounting boss (not shown in FIG. 1) attached to tool body 12. Blank assembly 32 can serve as a core or base component around which other features of wing shroud 30, or other wear members contemplated herein, can be fabricated. Although not limited to individually fabricated wear members, it is contemplated that the present disclosure will find applicability to fabricated wear members, as opposed to mass-produced castings, forgings, or others, as in certain instances a universal core piece can enable fabrication of relatively low volume or custom wear members, or wear members that are otherwise less well suited to large-scale production.

Figure 2:
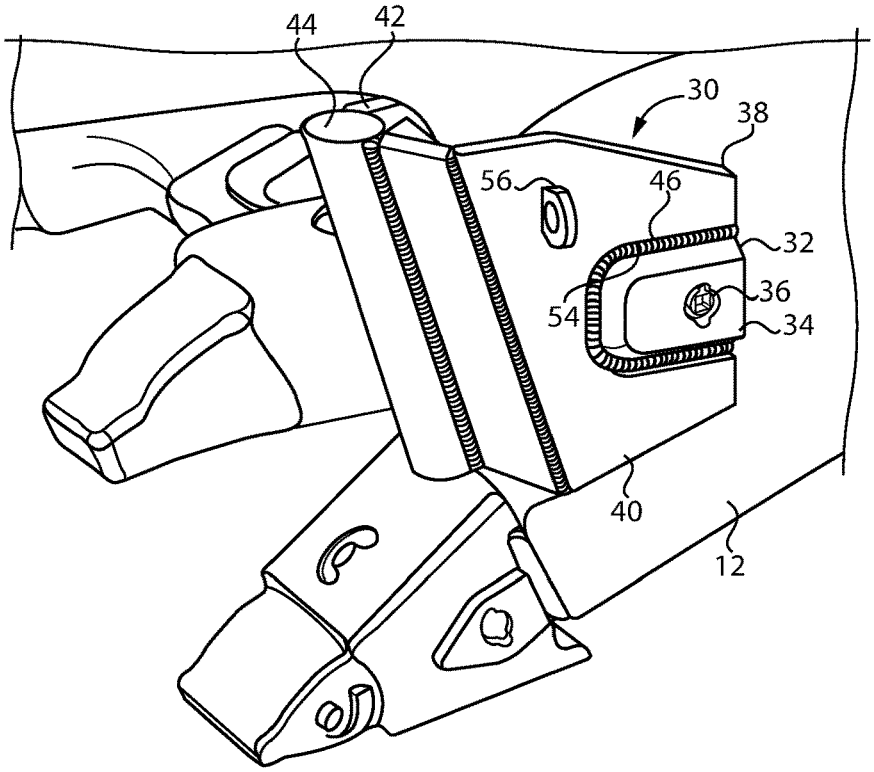
FIG. 2 is a diagrammatic view of a portion of the ground-engaging tool of FIG. 1.

Referring also now to FIG. 2, there are shown additional details of wing shroud 30, including a wear member body 38 having a first plate piece 40 and a second plate piece 42, joined together by welding with a connector 44. It should be appreciated that plate pieces 40 and 42 and connector 44 could all be formed from a single part rather than welding together multiple pieces, or formed from a number of body pieces greater than three. A lifting eye 56 may be attached to or integral with plate piece 40. Plate piece 40 can be attached to blank assembly 32, in particular to a blank 34 of blank assembly 32, by way of a weld 46. Blank assembly 32 also includes a lock 36 that can be used to releasably lock wing shroud 30 upon tool body 12 of ground-engaging tool 10 as further discussed herein.

Figure 3:
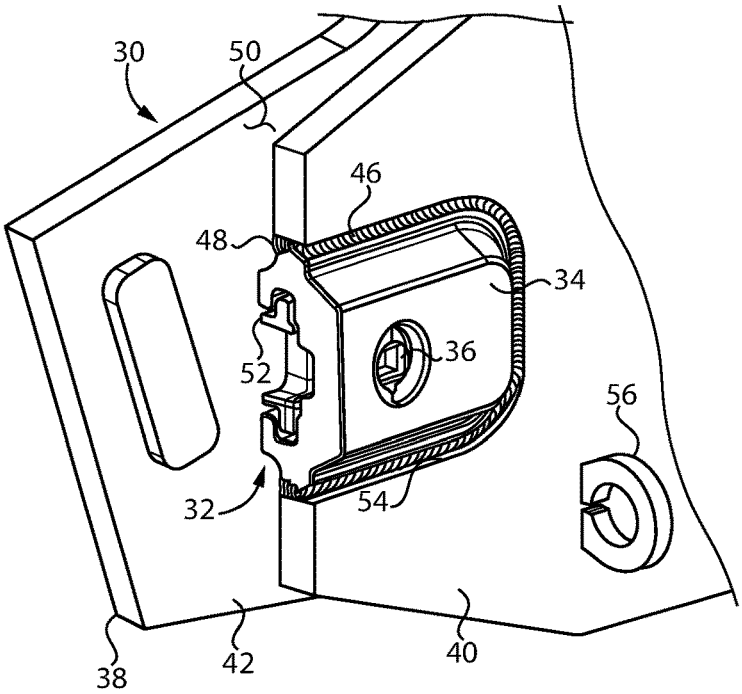
FIG. 3 is a diagrammatic view of a wear member decoupled from a ground-engaging tool, according to one embodiment.

Referring also now to FIG. 3, there is shown another view of wing shroud 30, wherein it can be seen that first plate piece 40 and second plate piece 42 are arranged in opposition such that a gap 50 extends therebetween. First plate piece 40 has a cutout 54 formed therein, and features of blank 34 are shaped complementary to cutout 54. It can also be seen that a second weld 48 attaches first plate piece 40 to blank 34, again further discussed herein. A boss 52 is shown as it might appear coupled with blank 34, and can be mounted to tool body 12 by any suitable means, such as by welding, bolting, or combinations of these.

Figure 4:
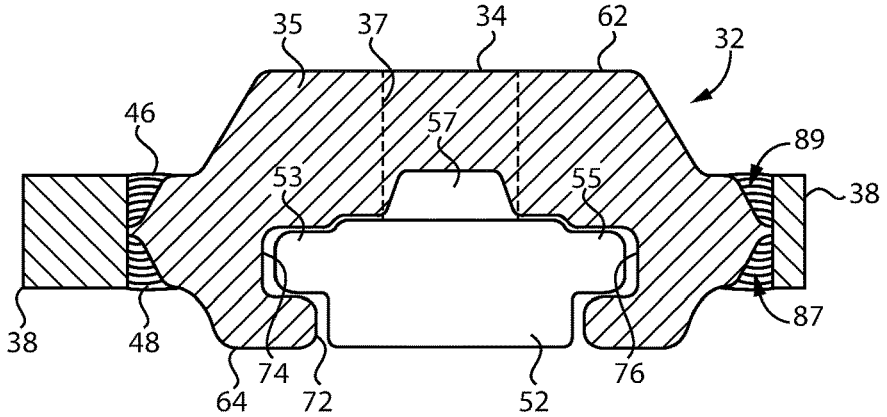
FIG. 4 is a sectioned view through a portion of the wear member of FIG. 3.
Figure 5:
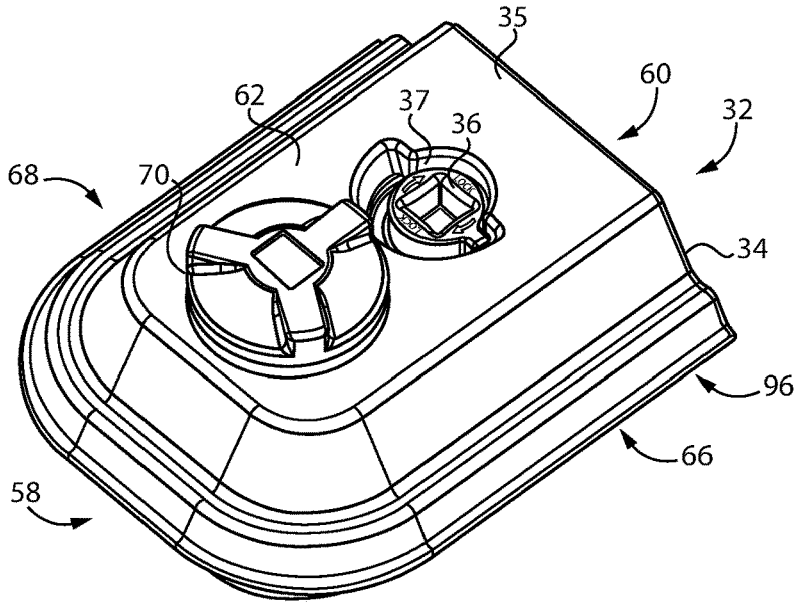
FIG. 5 is a diagrammatic view of a blank assembly for fabricating a wear member, according to one embodiment.
Figure 6:
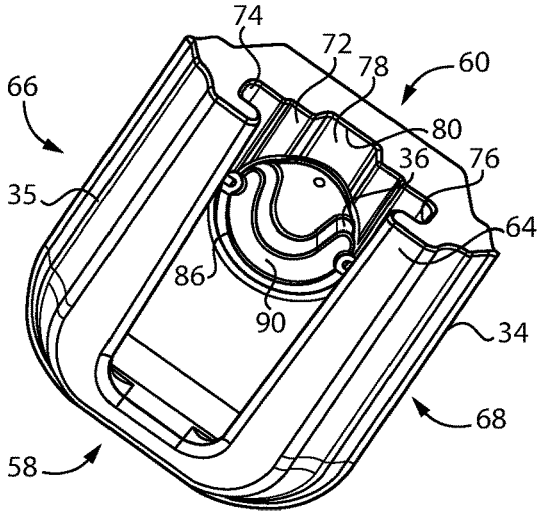
FIG. 6 is another view of the blank assembly of FIG. 5.

Referring also now to FIGS. 4, 5, and 6, there are shown features of blank assembly 32 and blank 34 in further detail. Blank 34 includes a one-piece block 35, such as a casting, a forging, or a machined piece of a suitable metallic material such as an iron or a steel. The terms blank 34 and block 35 should be understood as interchangeable except where otherwise indicated or apparent from the context. Block 35 includes a front end 58, a back end 60, an upper surface 62, a bottom surface 64, a first lateral side 66, and a second lateral side 68. FIG. 5 illustrates a wear cap 70 that may be affixed to block 35 for deflection of or contact with worked materials in some instances. A boss channel 72 is formed in block 35 and is open at bottom surface 64 and at back end 60. A lock bore 37 is also formed in block 35 and extends downwardly from upper surface 62 to boss channel 72, having features and functionality that are further discussed herein.

Boss channel 72 can include a first rail slot 74 extending in parallel with first lateral side 66, and a second rail slot 76 extending in parallel with second lateral side 68. Boss channel 72 further includes a roof slot 78, forming a roof of boss channel 72, and extending from an open end 80 located at back end 60 of block 35, to an opposite second end 82 intersecting lock bore 37. Blank 34 may further include an insert 86, such as a non-metallic insert of plastic or another polymeric material, having a frustoconical, or other slanted or sloped, partially arcuate, surface 84 forming second end 82 of boss channel 72. Boss 52 includes a first longitudinally extending boss rail 53 that is received in rail slot 74, and a second longitudinally extending boss rail 55 that is received in rail slot 76. Boss 52 also includes a boss protrusion 57 that extends upwardly, and is received generally in register with block bore 37 at second end 82 of boss channel 72. Boss protrusion 57 may also be frustoconical. Lock 36 may include tool engagement surfaces 88, into which a tool such as a square socket wrench tool can be mated, to rotate lock 36 between an engagement state and a disengagement state. Tool engagement surfaces 88 could form a male or female hex shape, for example, in other instances.

Figure 7:
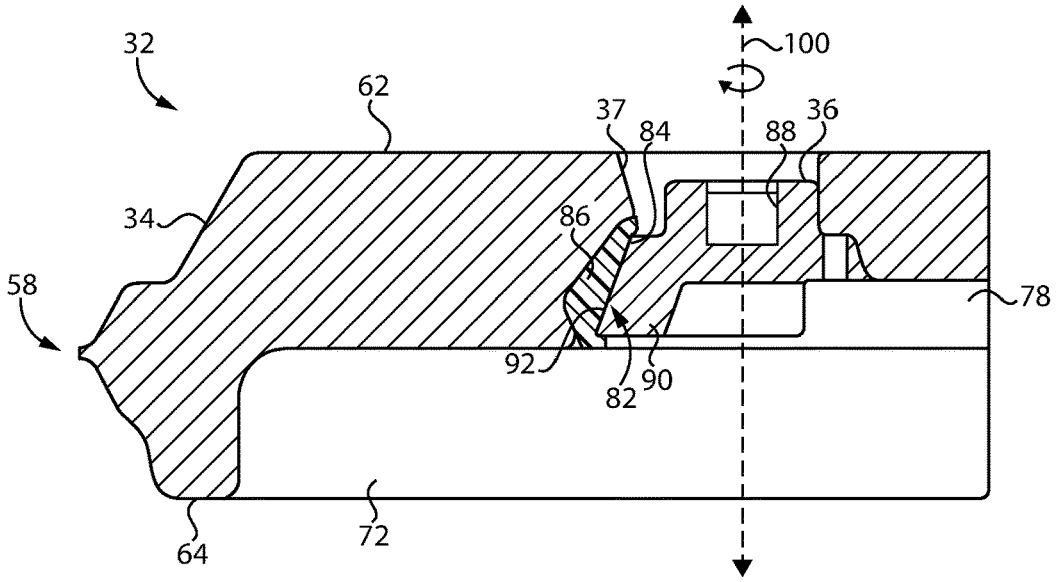
FIG. 7 is a sectioned view through the blank assembly of FIGS. 5 and 6.
Figure 8:
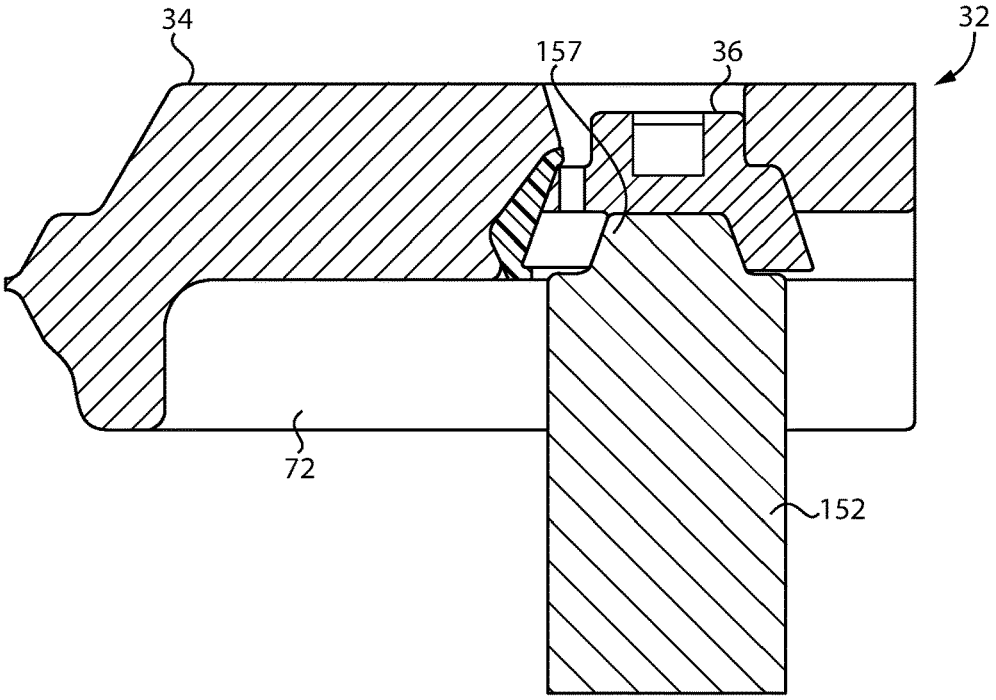
FIG. 8 is a sectioned view through a blank assembly as in FIGS. 5-7, in a mounting arrangement with a pin.

Referring also now to FIG. 7, there it can be seen that lock 36 is rotatable about an axis 100. Also shown in FIG. 7 is a foot 90 of lock 36 that includes an outer surface 92, shaped complementary to surface 84. Foot 90 may be generally C-shaped as shown in FIG. 6. Rotation of lock 36 can rotate lock 36 from an engagement state where lock 36, more particularly foot 90, blocks roof slot 78 at a location between second end 82 and back end 60 of block 35, to a disengagement state where lock 36 does not block roof slot 78 at that location between second end 82 and back end 60. In the configuration shown in FIG. 7, lock 36 is at the disengagement state, with outer surface 92 adjacent to inner surface 84 of insert 86. In the state depicted in FIG. 7, blank 34 can be slid onto and over boss 52 such that boss protrusion 57 is positioned just adjacent to foot 90. With boss 52 and blank 34 thus arranged, lock 36 can be rotated, for example, about 180°, to lock boss protrusion 57 from sliding in roof channel 78, and thereby securing blank 34 and an attached fabricated wear member body in place upon tool body 12. Referring to FIG. 8, there is shown an alternative arrangement where blank assembly 32 is engaged with a pin 152 having a pin boss 157. Pin 152 can be positioned in a bore in a ground-engaging tool, for example. It will be appreciated that a variety of boss configurations and overall mounting arrangements for a blank assembly in accordance with the present disclosure are possible. In FIG. 8 lock 36 has been rotated to trap blank assembly 32 in place relative to pin 152. When it is desirable to disassemble a wear member from a ground-engaging tool, lock 36 can be rotated back, approximately to the state depicted in FIG. 7, and the wear member slid off of the ground-engaging tool.

Figure 9:
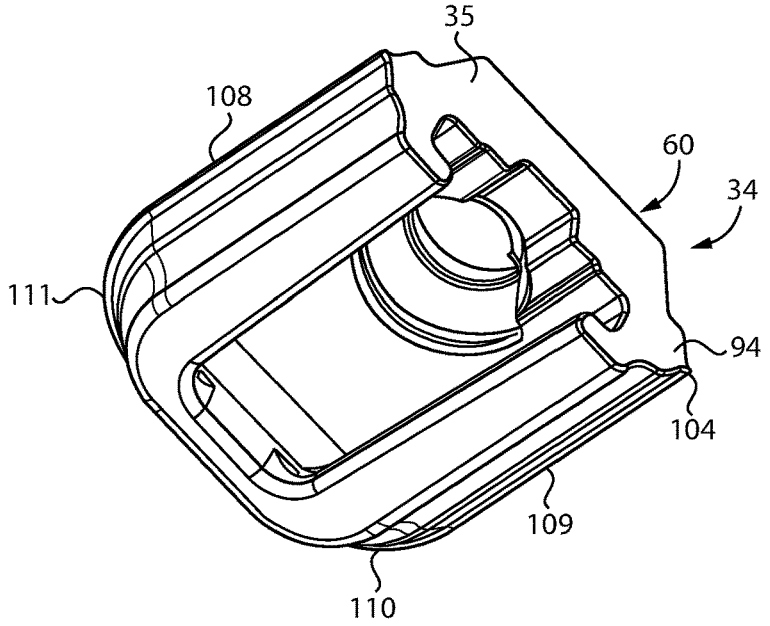
FIG. 9 is a diagrammatic view of a blank for a blank assembly, according to one embodiment.
Figure 10:
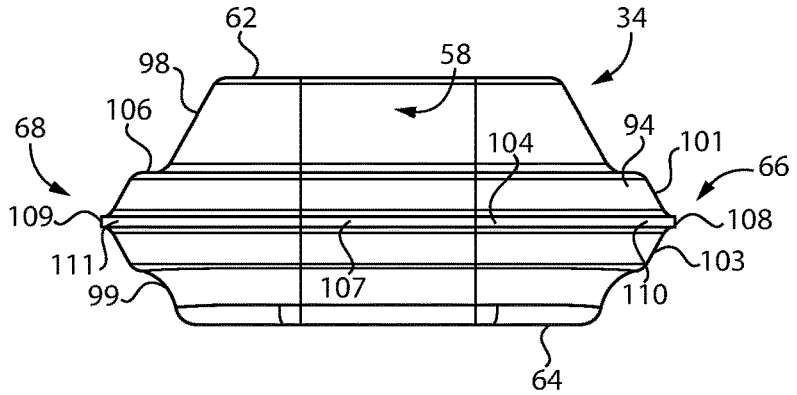
FIG. 10 is a front view of the blank of FIG. 9.
Figure 11:
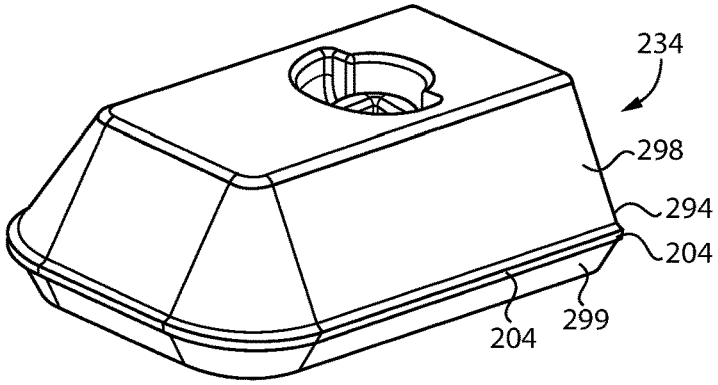
FIG. 11 is a diagrammatic view of a blank, according to another embodiment.

Referring also now to FIGS. 9, 10, and 11, block 35 further includes a peripheral edge 94 that projects upon each of first lateral side 66, second lateral side 68, and front end 58. Peripheral edge 94 is located vertically between upper surface 62 and bottom surface 64. Upper surface 62, bottom surface 64, and back end 60 may each be planar although the present disclosure is not limited as such. In the illustrated embodiment, peripheral edge 94 originates and terminates at back end 60, such that peripheral edge 94 forms a continuous welding interface 96 that is partially perimetric of block 35, for welding block 35 to a body of a wear member for a ground-engaging tool as discussed herein. Also in the illustrated embodiment, peripheral edge 94 has a U-shape and forms an outer perimeter of first lateral side 66, second lateral side 68, and front end 58.

Peripheral edge 94 may also include a projecting welding lip 104, and has a cross-sectional shape, in a transverse plane, that is vertically symmetric about welding lip 104. The transverse plane referred to in this context is a transverse plane that is generally orthogonal to a running length of lip 104. The transverse plane will be the plane of the page in FIG. 4, for instance, but would be at other orientations at other relative locations along peripheral edge 94. It can also be noted that a first groove 87 is formed between peripheral edge 94 and wear member body 38 upon a first side of welding lip 104, and is at least partially filled by material of weld 46. A second groove 89 is formed between peripheral edge 94 and wear member body 38 upon a second side of welding lip 104 and is at least partially filled by material of second weld 48. As noted above, peripheral edge 94 forms welding interface 96. Peripheral edge 94 and welding interface 96 have a U-shape in the illustrated embodiment, with the U-shape being complementary to a shape of cutout 54. Where cutout 54 has a different shape, a shape of peripheral edge 94, and welding lip 104, can differ accordingly. For instance, cutout 54 and peripheral edge 94 could each have a square shape, a semi-circular shape, a rectangular shape, a trapezoidal shape, a V-shape, or still another.

Each of first lateral side 66, second lateral side 68, and front end 58, may slope, in a direction of peripheral edge 94, downwardly and outwardly from upper surface 62, and upwardly and outwardly from bottom surface 64. With particular reference to FIG. 5, peripheral edge 94 may be located outside of a footprint defined by upper surface 62, and outside of a footprint defined by bottom surface 64, in a projection plane. Accordingly, looking down on block 35 in elevation, a perimeter of upper surface 62, and a perimeter of bottom surface 64, would each be inside of a perimeter of peripheral edge 94, in a projection plane. It can also be noted that block 35 includes an upper side surface 98, and a lower side surface 99, each of which slopes toward peripheral edge 94. In the illustrated embodiment, a transition surface 106, that is generally horizontally oriented, transitions between upper side surface 98 and peripheral edge 94. Lower side surface 99 can have a concave inward shape, in profile, whereas upper side surface 98 may have, in profile, a generally linear shape, approximately as depicted in FIG. 10. Peripheral edge 94 itself may include an upper edge surface 101 that slopes from transition surface 106 toward lip 104, and a lower edge surface 103 that also slopes toward edge 104, from lower side surface 99, with lip 104 generally being located at a convergence of surfaces 101 and 103. Peripheral edge 94 may have a first linear segment 108 upon first side 66, a second linear segment 109 upon second lateral side 68, and a third linear segment 107 upon front end 58. A first curved segment 110 transitions between front end 58 and first lateral side 66, and a second curved segment 111 transitions between front end 58 and second lateral side 68.

Turning now to FIG. 11, there is shown a blank 234 according to another embodiment. Blank 234 may be coupled with a lock to produce a blank assembly functionally similar to foregoing embodiments, but having certain differences. Blank 234 includes an upper side surface 298, and a lower side surface 299, that slope toward convergence to form a peripheral edge 294. Peripheral edge 294 will be understood to project upon lateral sides and a front end of blank 234, and originates and terminates at a back end, generally analogous to the foregoing embodiments. Blank 234 also includes a welding lip 204 upon peripheral edge 294. An upper half of blank 234, above lip 204, may have a profile that defines three sides of a trapezoidal shape, while a lower portion below lip 204 has a profile that defines three sides of another trapezoidal shape. Upper side surface 298 slopes all the way to peripheral edge 294, as does lower side surface 299, and transition surfaces are not interposed the side surfaces and peripheral edge 294.

Figure 12:
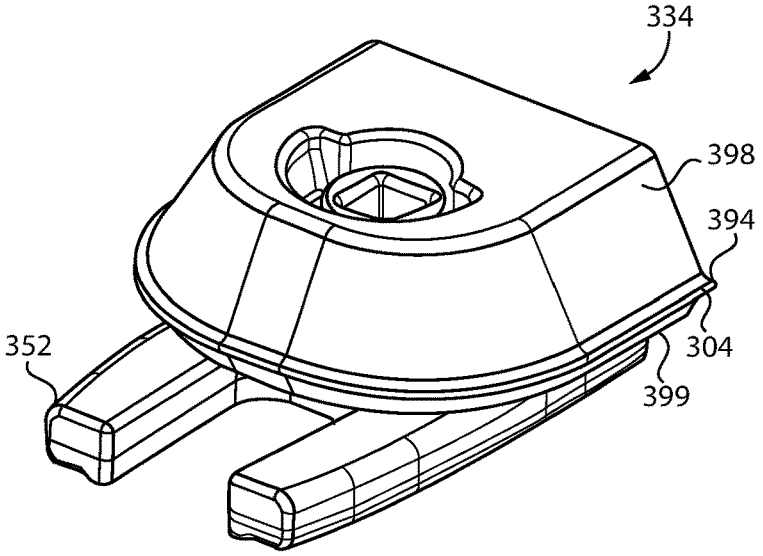
FIG. 12 is a diagrammatic view of a blank assembly mounted upon a boss, according to yet another embodiment.

Referring now to FIG. 12, there is shown another blank 334 as it might appear upon a boss 352, which can be attached to a body of a ground-engaging tool generally analogous to preceding embodiments. Blank 334 includes an upper side surface 398, and a lower side surface 399, which slope toward convergence and form a peripheral edge 394 having a welding lip 304. It can be noted that a shape of blank 334 is relatively more rounded across its front than in the preceding embodiments, and is generally semi-circular in shape.

Figure 13:
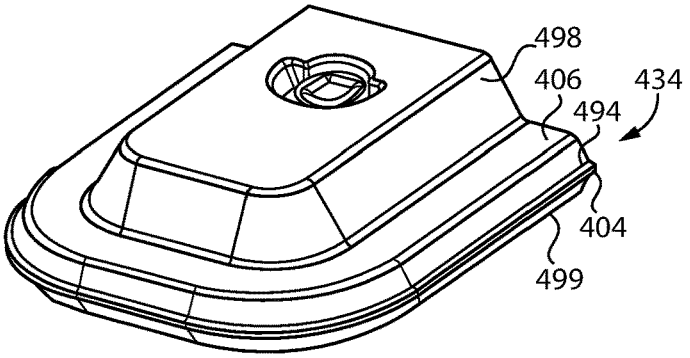
FIG. 13 is a diagrammatic view of a blank assembly, according to yet another embodiment.
Figure 14:
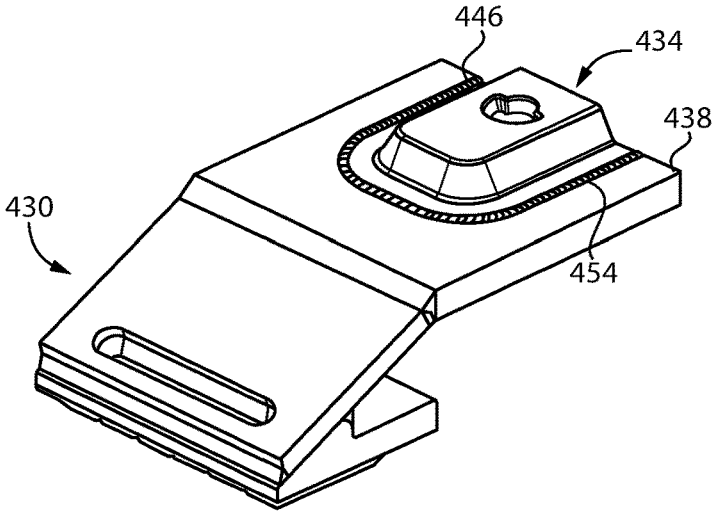
FIG. 14 is a diagrammatic view of a wear member, according to one embodiment.
Figure 15:
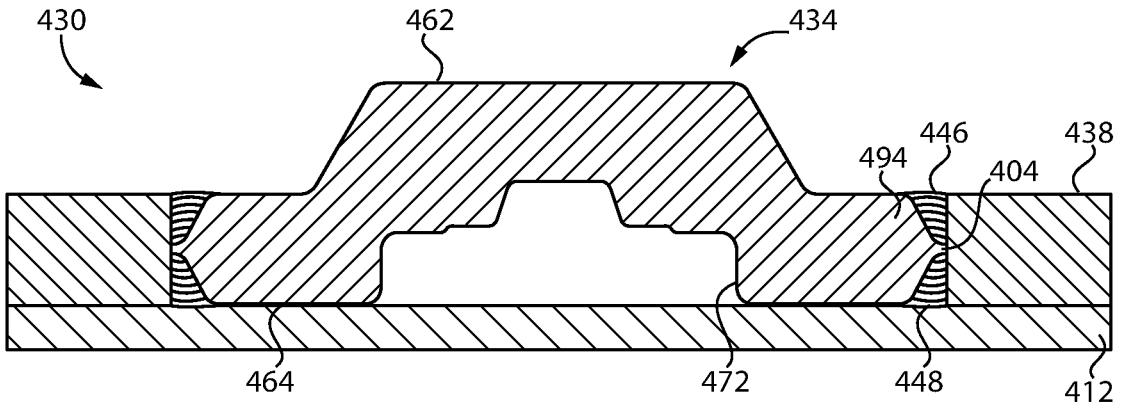
FIG. 15 is a sectioned view through a portion of the wear member of FIG. 14 shown mounted upon a ground-engaging tool.
Figure 16:
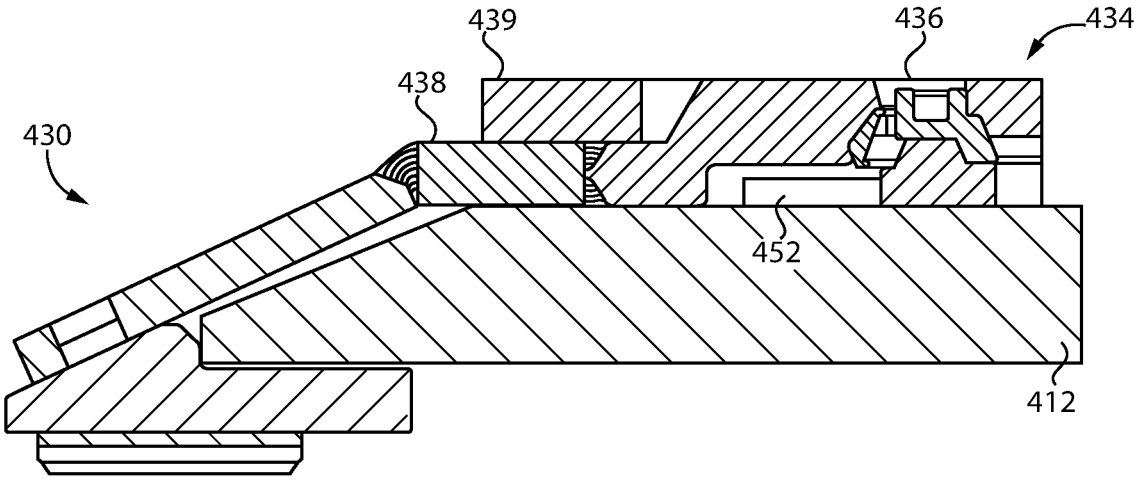
FIG. 16 is another sectioned view through the wear member of FIGS. 14 and 15, shown mounted upon a ground-engaging tool.

Yet another embodiment is shown in FIG. 13 where a blank 434 includes a sloping upper surface 498, a sloping lower side surface 499, and a peripheral edge 494 having a welding lip 404. A transition surface 406 transitions between upper side surface 498 and peripheral edge 494. In FIG. 14 blank 434 is shown as it might appear attached within a cutout 454 to a wear member body 438 by way of a weld 454 to form a wear member 430 suitable for use as an edge shroud. FIG. 15 depicts a sectioned view where blank 434 is shown attached to wear member body 438 by way of a first weld 446 and a second weld 448 upon upper and lower sides, respectively, of peripheral edge 494 and welding lip 404. Bottom surface 464 is shown opposite an upper surface 462. As in the illustrations of FIG. 4 and FIG. 12, some embodiments can be structured so that the wear member body is elevated slightly above the surface of the body of the ground-engaging tool. In FIG. 15, wear member body 438 sits flush upon body 412 of a ground-engaging tool. Blank 434 also differs in the structure of boss channel 472, which does not include rail slots in the manner of the embodiment of FIG. 4. FIG. 16 illustrates a sectioned side view of wear member 430 upon tool body 412, where a lock 436 is shown rotated to engage with a boss 452. Also in the embodiment of FIG. 16 an additional wear member plate piece 439 or the like is positioned upon the welded interface attaching wear member body 438 to blank 434. Plate piece 439 could have a U-shape tracking the path of weld 446.

INDUSTRIAL APPLICABILITY

From the foregoing description, it will be appreciated that wear members can be uniquely fabricated for a variety of applications, while being structured to be used with existing locking systems. Accordingly, wear members having unique geometry, or formed from unique materials for specific service applications, such as hardened materials or sacrificial wear materials, can be built around a common core component while having essentially unlimited flexibility in design. The rotatable locking mechanisms discussed herein are also but one example of locking systems and configuration that could be used. In the illustrated embodiments, each blank assembly is shown equipped with a single rotatable lock. Other embodiments could include multiple rotatable locks, accommodating multiple boss protrusions on a single boss or multiple bosses, multiple boss protrusions on separate boss pins, or still another arrangement. Moreover, while rotatable locks having a lock member that rotates around a boss protrusion as disclosed herein are contemplated to provide a practical implementation strategy, in other instances an altogether different lock configuration could be used. Threaded engagements between a mounting bolt passed through a blank and receiving threads in a boss, or in a body or insert in a ground-engaging tool, could alternatively be used.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A blank for fabricating a wear member for a ground-engaging tool comprising:

a one-piece block unattached to a wear member, and including a front end, a back end, an upper surface, a bottom surface, a first lateral side and a second lateral side;

a boss channel is formed in the one-piece block and is open at the bottom surface and at the back end;

a lock bore is formed in the one-piece block and extends downwardly from the upper surface to the boss channel, and the boss channel extends in a forward direction from the back end and is open continuously at the bottom surface from the back end to a location of the lock bore;

the one-piece block further including a peripheral edge that projects upon each of the first lateral side, the second lateral side, and the front end; and the peripheral edge is located vertically between the upper surface and the bottom surface, and the peripheral edge forming a welding interface that is partially perimetric of the one-piece block.

2. The blank of claim 1 wherein the peripheral edge includes a welding lip, and wherein a first groove is formed on a first vertical side of the welding lip and a second groove is formed on a second vertical side of the welding lip.

3. The blank of claim 2 wherein a transverse vertical plane is defined orthogonal to the welding lip, and the peripheral edge has a cross-sectional shape that is vertically symmetric about the welding lip in the transverse plane.

4. The blank of claim 1 further comprising a non-metallic insert positioned within the boss channel.

5. The blank of claim 1 wherein the one-piece block further includes a sloping surface extending between the upper surface and the peripheral edge, and a transition surface extending horizontally between the sloping surface and the peripheral edge.

6. The blank of claim 5 wherein each of the sloping surface, the transition surface, and the peripheral edge originates and terminates at the back end of the one-piece block.

7. The blank of claim 6 wherein the peripheral edge includes a welding lip.

8. A blank for fabricating a wear member for a ground-engaging tool comprising:

a one-piece block including a front end, a back end including a back end surface, an upper surface, a bottom surface, a first lateral side and a second lateral side;

a downwardly opening boss channel is formed in the one-piece block;

the one-piece block further including a peripheral edge that projects upon each of the first lateral side, the second lateral side, and the front end; and the peripheral edge is located vertically between the upper surface and the bottom surface, and includes a welding lip originating and terminating at the back end surface.

9. The blank of claim 8 wherein the welding lip upon the first lateral side is parallel to the welding lip upon the second lateral side.

10. The blank of claim 9 wherein the welding lip forms a U-shape.

11. The blank of claim 8 wherein the peripheral edge is located outside of a footprint defined by the upper surface, and outside of a footprint defined by the bottom surface, in a projection plane.

12. The blank of claim 8 wherein a roof slot in communication with the boss channel is formed in the one-piece blank.

13. The blank of claim 12 wherein a rail slot in communication with the boss channel is formed in the one-piece blank.

* * * * *